United States Patent [19]

Chow

[11] Patent Number: 4,686,936

[45] Date of Patent: Aug. 18, 1987

[54] LIQUID DEVELOPMENT SYSTEM

[75] Inventor: Che C. Chow, Penfield, N.Y.

[73] Assignee: Xerox Corporation, Stamford, Conn.

[21] Appl. No.: 865,711

[22] Filed: May 22, 1986

[51] Int. Cl.[4] ..... G03G 15/10

[52] U.S. Cl. ..... 118/661

[58] Field of Search ..... 118/661

[56] References Cited

U.S. PATENT DOCUMENTS 3,245,381 4/1966 Brenneisen et al. ..... 118/637

4,021,586 5/1977 Matkan ..... 427/17

*Primary Examiner*—Bernard D. Pianalto

*Attorney, Agent, or Firm*—H. Fleischer; J. E. Beck; R. Zibelli

[57] ABSTRACT

An electrophotographic printing machine in which an electrostatic latent image recorded on a photoconductive member is developed with a liquid developer material having at least a liquid carrier with marking particles dispersed therein. The liquid developer material is advanced on a roll from a supply thereof to the latent image at a development zone. Marking particles are moved through the liquid carrier onto the surface of the roll and a resilient blade removes excessive liquid developer material from the roll prior to the development zone.

8 Claims, 2 Drawing Figures

LIQUID DEVELOPMENT SYSTEM

This invention relates generally to an electrophotographic printing machine, and more particularly concerns a development system for developing an electrostatic latent image with a liquid development material comprising at least a liquid carrier having marking particles dispersed therein.

A typical electrophotographic printing machine employs a photoconductive member that is charged to a substantially uniform potential so as to sensitize the surface thereof. The charged portion of the photoconductive member is exposed to a light image of an original document being reproduced. Exposure of the charged photoconductive member selectively dissipates the charge thereon, in the irradiated areas, to record an electrostatic latent image on the photoconductive member corresponding to the informational areas contained within the original document. After the electrostatic latent image is recorded on the photoconductive member, the latent image is developed by bringing a developer material into contact therewith. Generally, the electrostatic latent image is developed with a dry developer material comprising carrier granules having toner particles adhering triboelectrically thereto. The toner particles are attracted to the latent image forming a visible powder image on the photoconductive surface. After the electrostatic latent image is developed with the tone particles, the toner powder image is transferred to a copy sheet. Thereafter, the toner powder image is heated to permanently fuse it to the copy sheet.

Alternatively, the electrostatic latent image may be developed by furnishing a liquid ink developer material thereto. Various types of liquid ink development systems have heretofore been utilized. An early system embodying such concept is disclosed in U.S. Pat. No. 3,084,043, issued to Gundlach on Apr. 2, 1963. Though specific liquid development systems vary, a typical system includes a gravure roll adapted to receive liquid developer material. Upon receipt of the liquid developer material, a doctor blade is conventionally applied to the gravure roll in an effort to remove excessive fluid which would otherwise interfere with the accurate reproduction of the selected image. The fluid carrying gravure roll is then typically rotated into a position wherein the electrostatic latent image recorded on the photoconductive surface attracts the liquid developer material thereto in image configuration.

In high capacity electrophotographic printing machines, a major consideration in the utilization of a liquid development system is the amount of liquid carrier required to be removed in the subsequent reclamation in order to meet environmental concerns. Thus, it is highly desirable to be capable of reducing the amount of liquid developer material deposited on the photoconductive surface so as to reduce the amount of liquid carrier deposited thereon. Preferably, only the marking particles will be deposited on the electrostatic latent image in image configuration. Various types of liquid development systems have heretofore been employed. The following disclosure is to be relevant:

U.S. Pat. No. 3,245,381

Patentee: Brenneisen et al.,

Issued: Apr. 12, 1966

The relevant portions of the foregoing disclosure may be briefly summarized as follows:

Brenneisen discloses a liquid development system wherein a trough contains a liquid developer material which is applied to a developing roller with the aid of an applying roller. An excess of developing liquid is removed by a squeegee roller which is swingably mounted. The squeegee roller is pressed against the developing roller with the aid of a spring. A motor drives the applying roller. The developing roller is driven by the applying roller. The developing roller is gravured and made of a material which is wettable by liquid developer.

In accordance with one aspect of the features of the present invention, there is provided an apparatus for developing a latent image recorded on a member with a liquid developer material comprising at least a liquid carrier having marking particles dispersed therein. Means are provided for storing a supply of liquid developer material. Means advance the liquid developer material from the storing means to the latent image at a development zone. Means move at least a portion of the marking particles through the liquid carrier onto the surface of the advancing means before the development zone to increase the density of marking particles being deposited on said advancing means.

Pursuant to another aspect of the features of the present invention, there is provided an electrophotographic printing machine of the type having an electrostatic latent image recorded on a photoconductive member developed with a liquid developer material comprising at least liquid carrier having marking particles dispersed therein. Means store a supply of liquid developer material. Means are provided for advancing the liquid developer material from the storing means to the latent image at a development zone. Means move at least a portion of the marking particles through the liquid carrier onto the surface of the advancing means before the development zone to increase the density of the marking particles being deposited on said advancing means.

Other aspects of the present invention will become apparent as the following description proceeds and upon reference to the drawings, in which.

While the present invention will hereinafter be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 1:
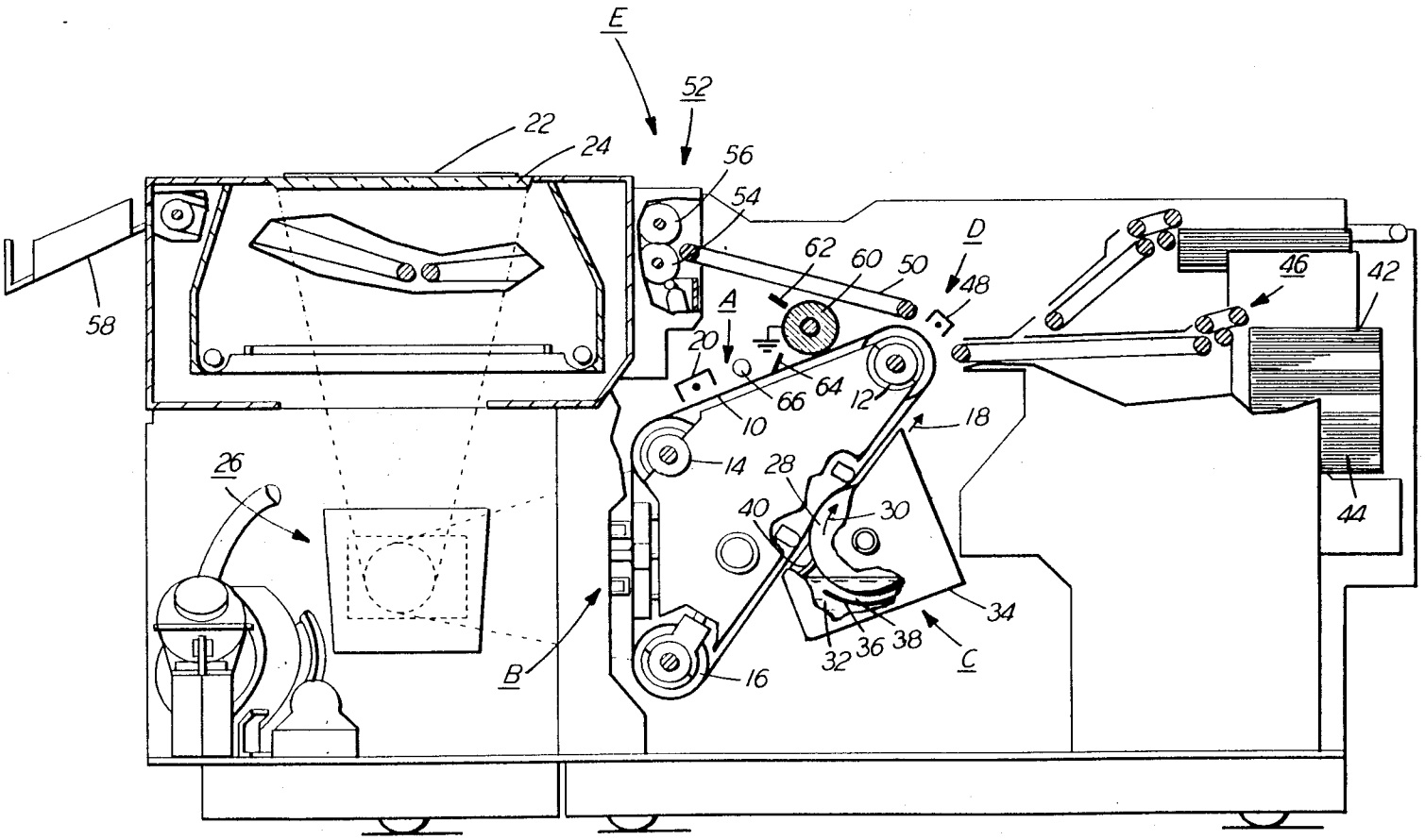
FIG. 1 is a schematic elevational view depicting an electrophotographic printing machine incorporating the features of the present invention therein.

For a general understanding of the features of the present invention, reference is made to the drawings. In the drawings, like reference numerals have been used throughout to designate identical elements. FIG. 1 is a schematic elevational view illustrating an electrophotographic printing machine incorporating the features of the present invention therein. It will become apparent from the following discussion that the apparatus of the present invention is equally well suited for use in a wide variety of printing machines and is not necessarily limited in its application to the particular embodiment shown herein.

Turning now to FIG. 1, the printing machine employs a belt 10 having a photoconductive surface deposited on a conductive substrate. Preferably, the photoconductive surface is made from a selenium alloy with the conductive substrate being preferably made from an aluminum alloy which is electrically grounded. Belt 10 advances successive portions of the photoconductive surface sequentially through the various processing stations disposed about the path of movement thereof. The support assembly for belt 10 includes three rollers, 12, 14, and 16 located with parallel axes at approximately the apexes of a triangle. Roller 12 is rotatably driven by a suitable motor and drive (not shown) so as to rotate and advance belt 10 in the direction of arrow 18.

Initially, belt 10 passes through charging station A. At charging station A, a corona generating device 20 charges the photoconductive surface of belt 10 to a relatively high, substantially uniform potential.

After the photoconductive surface of belt 10 is charged, the charged portion thereof, is advanced to exposure station B. At exposure station B, an original document 22 is placed upon a transparent support platen 24. An illumination assembly, indicated generally by the reference number 26, illuminates the original document 22 on platen 24 to produce image rays corresponding to the informational areas of the original document. The image rays are projected by means of an optical system onto the charged portion of the photoconductive surface. The light image dissipates the charge in selected areas to record an electrostatic latent image on the photoconductive surface corresponding to the informational areas contained within original document 22.

After the electrostatic latent image has been recorded on the photoconductive surface of belt 10, belt 10 advances the electrostatic latent image to development station C. At development station C, a developer roller 28 rotates in the direction of arrow 30 to advance a liquid developer material into contact with the electrostatic latent image recorded on the photoconductive surface of belt 10. The liquid developer material, indicated generally by the reference numeral 32, is stored in the chamber of housing 34. Roll 28 is preferably a gravure roll which is partially immersed in liquid developer material 32 located in the chamber of housing 34. An electrode 36 totally immersed in the liquid developer material 34 is closely spaced from roll 28 to define a channel 38 through which the liquid material passes. The liquid developer material comprises an insulating liquid carrier having marking or toner particles dispersed therein. Electrode 36 is electrically biased to generate an electrical field in channel 38 which causes the toner particles to move through the liquid carrier and be deposited onto gravure roll 28. A metering blade 40 removes the excessive material adhering to gravure roll 28. Development station C will be further described hereinafter with reference to FIG. 2.

With continued reference to FIG. 1, after the latent electrostatic latent image is developed, belt 10 advances the developed image to transfer station D. At transfer station D, a sheet of support material 42 is advanced from stack 44 by a sheet transport mechanism, indicated generally by the reference numeral 46. Transfer station D includes a corona generating device 48 which sprays ions onto the backside of the sheet of support material, i.e., copy sheet 42. This attracts the developed image from the photoconductive surface of belt 10 to copy sheet 42. Conveyor belt 50 moves the copy sheet to drying station E.

Drying station E includes a drying assembly, indicated generally by the reference numeral 52, which permanently fixes the developed image to the copy sheet. Drying assembly 52 includes a heated roll 54 and a back-up or pressure roll 56 resiliently urged into engagement therewith to form a nip through which the copy sheet passes. In the drying operation, the liquid carrier is vaporized and the toner particles coalesce with one another and bond to the copy sheet in image configuration. After fixing, the finished copy sheet is discharged to output tray 58 for removal therefrom by the machine operator.

After the developed image is transferred to the copy sheet, residual liquid developer material remains adhering to the photoconductive surface of belt 10. A cleaning roller 60, formed of any appropriate synthetic resin, is driven in a direction opposite to the direction of movement of belt 10 to scrub the photoconductive surface clean. To assist in this action, developing liquid may be fed through pipe 62 to the surface of cleaning roller 60. A wiper blade 64 completes the cleaning of the photoconductive surface. Any residual charge left on the photoconductive surface is extinguished by flooding the photoconductive surface with light from lamps 66.

Figure 2:
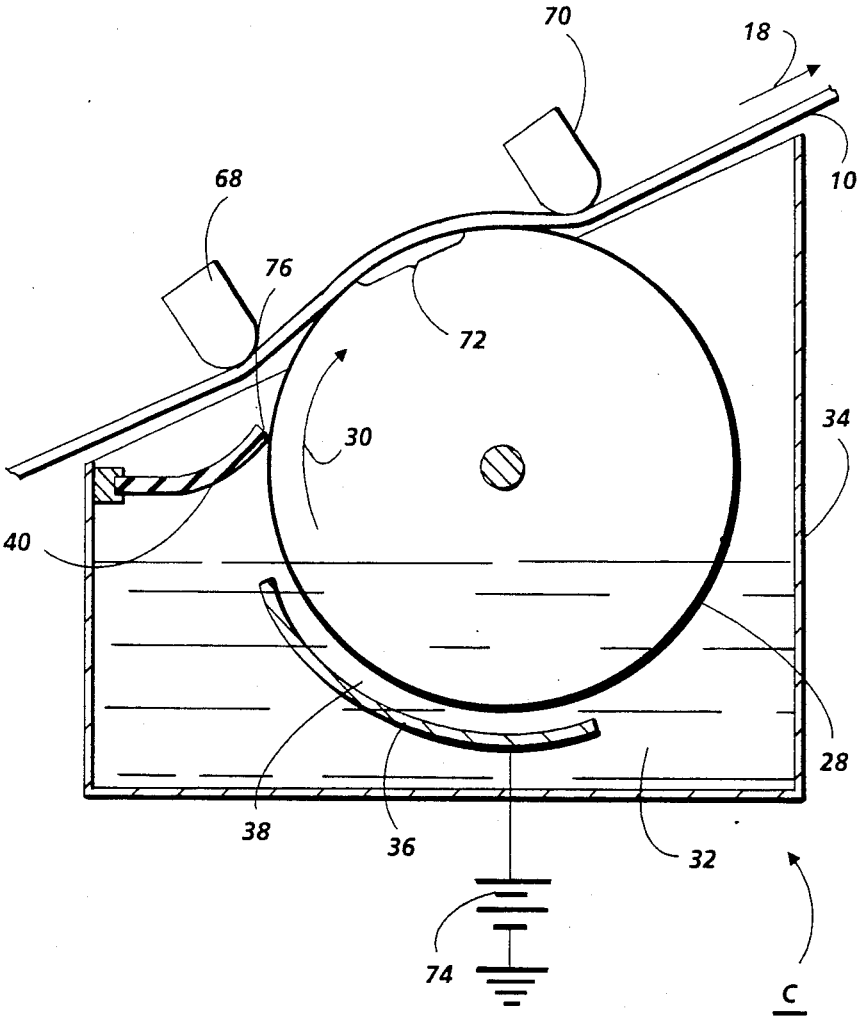
FIG. 2 is an elevational view showing the development system used in the FIG. 1 printing machine.

Referring now to FIG. 2, there is shown the detailed structure of development station C. As shown thereat, gravure roll 28 is in engagement with belt 10. Guides 68 and 70 confine the path of movement of belt 10. Belt 10 wraps about the exterior circumferential surface of roll 28 to define an extended development zone 72. By way of example, extended development zone 72 may vary from about 1° to about 40°. Though not mandatory, an extended development zone has been found to improve development of the electrostatic latent image recorded on the photoconductive surface of belt 10. Gravure roll 28 has a plurality of pockets or grooves which are filled with the liquid ink developer material as the roll rotates through the liquid developer material 32 in the chamber of housing 34. Gravure roll 28 is electrically biased to a suitable potential and magnitude so that the toner particles are deposited on the electrostatic latent image recorded on the photoconductive surface of belt 10, in image configuration, as roll 28 passes through development zone 72. By way of example, the liquid developer material comprises an insulating carrier liquid which may be a hydrocarbon liquid, although other insulating liquids may also be employed. A suitable hydrocarbon liquid is an isopar, which is a trademark of the Exxon Corporation. These are branched, chained aliphatic hydrocarbon liquids (largely decane). The toner particles comprise a binder and a pigment. The pigment may be carbon black. However, one skilled in the art will appreciate that any suitable liquid developer material may be employed. One such suitable developer material is described in U.S. Pat. No. 4,582,774 issued to Landa in 1986, the relevant portions thereof being hereby incorporated into the present application.

As is shown in FIG. 2, gravure roll 28 is partially immersed in liquid developer material 32. A packing electrode, 36 positioned closely adjacent to roll 28, is spaced therefrom to define channel 38 therebetween. Electrode 36 is totally immersed in liquid developer material 32. Packing electrode 36 is made from a conductive metal material as is roll 28. Voltage source 74 electrically biases electrode 36 to a suitable potential and magnitude with respect to the electrical bias applied on roll 28 so that the toner particles in the liquid developer material 32 are deposited on roll 28 increasing the density packing of the pigmented toner particles being transported by gravure roll 28 in the direction of arrow 30. Gravure roll 28 then transports the toner particles to metering blade 40. Preferably, metering blade 40 is made from a resilient material, such as an elastomeric material, with the free end portion 76 thereof engaging the exterior circumferential surface of roll 28 so as to control the thickness of the toner particles in the pockets or grooves of roll 28 to a substantially uniform thickness and to remove excessive liquid carrier material from roll 28 such that the outer circumference of the lands of the gravure roll is substantially wiped clean. Thereafter, roll 28 advances the developer material into development zone 72 wherein the electrostatic latent image recorded on the photoconductive surface of belt 10 has the toner particles deposited thereon in image configuration. Since there is no development in the non-image areas of the photoconductive surface, this portion of the surface remains substantially free of any liquid carrier of the liquid developer material. Hence, there is no liquid carrier transferred subsequently to the copy sheet from the non-image areas of the photoconductive surface.

In recapitulation, it is clear that the development system of the present invention employs a gravure type of developer roll whose outer circumference is substantially wiped clean by a resilient blade prior to development. The resilient blade also controls the level of the liquid developer material on the gravure roll or in the pockets thereof. The development system also employs a packing electrode totally immersed in the liquid developer material to increase the density of toner particles on the surface of a gravure roll. In this way, the density of marking particles being transported to the development zone is significantly increased resulting in improved development of the electrostatic latent image recorded on the photoconductive surface. Furthermore, image development from a gravure roll prevents the non-image areas from being wetted with liquid carrier, thereby greatly reducing the total amount of liquid carrier transferred to the copy sheet and the resultant loss to the environment.

It is, therefore, apparent that there has been provided, in accordance with the present invention a development apparatus which fully satisfies the aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications and variations that fall within the spirit and broad scope of the appended claims.

I claim:

1. An apparatus for developing a latent image recorded on a flexible belt with a liquid developer material comprising at least a liquid carrier having marking particles dispersed therein, including:

means for storing a supply of liquid developer material;

a gravure, roll at least partially immersed in the supply of liquid developer material in said storing means, for advancing liquid developer material from said storing means to the latent image at a development zone, said flexible belt being wrapped about a portion of the exterior circumferential surface of said gravure roll so that the developement zone is an extended development zone;

an electrode positioned closely adjacent said gravure roll and immersed in the supply of liquid developer material to define a channel therebetween having liquid developer material therein; and means for electrically biasing said electrode to cause a portion of the marking particles in the liquid developer material in the channel to move through the liquid developer material onto the surface of said gravure roll so as to increase the density of marking particles deposited on said gravure roll.

2. An apparatus according to claim 1, further including means, interposed between the development zone and said moving means, for regulating the amount of liquid developer material being advanced by said gravure roll into the development zone.

3. An apparatus according to claim 2, wherein said regulating means is spaced from the supply of liquid developer material in said storing means.

4. An apparatus according to claim 3, wherein said regulating means includes a resilient blade having the free end portion thereof contacting gravure said roll to remove excessive liquid carrier adhering to said gravure roll and to regulate the thickness of the liquid developer material remaining thereon.

5. An electrophotographic printing machine of the type having an electrostatic latent image recorded on a flexible photoconductive belt developed with a liquid developer material comprising at least a liquid carrier having marking particles dispersed therein, wherein the improvement includes:

means for storing a supply of liquid developer material;

a gravure, roll at least partially immersed in the supply of liquid developer material in said storing means, for advancing liquid developer material from said storing means to the latent image at a development zone, said flexible photoconductive belt being wrapped about a portion of the exterior circumferential surface of said gravure roll so that the developement zone is an extended development zone;

an electrode positioned closely adjacent said gravure roll and immersed in the supply of liquid developer material to define a channel therebetween having liquid developer material therein; and means for electrically biasing said electrode to cause a portion of the marking particles in the liquid developer material in the channel to move through the liquid developer material onto the surface of said gravure roll so as to increase the density of marking particles deposited on said gravure roll.

6. A printing machine according to claim 5, further including means, interposed between the development zone and said moving means, for regulating the amount of liquid developer material being advanced by said gravure roll into the development zone.

7. A printing machine according to claim 6, wherein said regulating means is spaced from the supply of liquid developer material in said storing means.

8. A printing machine according to claim 7, wherein said regulating means includes a resilient blade having the free end portion thereof contacting said gravure roll to remove excessive liquid carrier adhering to said gravure roll and to regulate the thickness of the liquid developer material remaining thereon.

* * * * *